US008596725B2

(12) United States Patent
Monyak et al.

(10) Patent No.: US 8,596,725 B2
(45) Date of Patent: Dec. 3, 2013

(54) FULL SLEEVE RETAINER FOR STEP-SHANK OF TOOL

(75) Inventors: Kenneth Monyak, Abingdon, VA (US); Joseph Fader, Abingdon, VA (US)

(73) Assignee: Sandvik Intellectual Property AB, Sandviken (SE)

( * ) Notice: Subject to any disclaimer, the term of this patent is extended or adjusted under 35 U.S.C. 154(b) by 259 days.

(21) Appl. No.: 13/059,316

(22) PCT Filed: Jun. 22, 2009

(86) PCT No.: PCT/SE2009/050786

§ 371 (c)(1), (2), (4) Date: Apr. 26, 2011

(87) PCT Pub. No.: WO2010/021582

PCT Pub. Date: Feb. 25, 2010

(65) Prior Publication Data

US 2011/0193399 A1 Aug. 11, 2011

Related U.S. Application Data

(60) Provisional application No. 61/089,725, filed on Aug. 18, 2008.

(51) Int. Cl.
*E21C 35/197* (2006.01)

(52) U.S. Cl.
USPC ..... 299/104; 299/107

(58) Field of Classification Search
USPC ..... 299/104, 107
See application file for complete search history.

(56) References Cited

U.S. PATENT DOCUMENTS

| | | | | |
|---|---|---|---|---|
| 3,650,565 | A * | 3/1972 | Kniff | 299/106 |
| 4,159,746 | A * | 7/1979 | Wrulich et al. | 299/111 |
| 4,201,421 | A | 5/1980 | Den Besten et al. | |
| 4,850,649 | A * | 7/1989 | Beach et al. | 299/107 |
| 5,415,462 | A | 5/1995 | Massa | |
| 5,503,463 | A | 4/1996 | Ojanen | |
| 2005/0088034 | A1 | 4/2005 | Clemenson | |
| 2006/0125308 | A1 | 6/2006 | Sollami | |
| 2007/0152495 | A1 | 7/2007 | Sollami | |
| 2008/0036274 | A1 | 2/2008 | Hall et al. | |

* cited by examiner

*Primary Examiner* — John Kreck

(74) *Attorney, Agent, or Firm* — Morgan, Lewis & Bockius LLP

(57) ABSTRACT

A tool pick assembly and a tool and block assembly are disclosed. A sleeve is positioned about the shank to allow rotation of the tool pick and also friction fit with the block. The sleeve is stepped in complement to the shape of the surface of the shank of the tool pick and the shape of the surface of the bore in the tool holder and extends substantially all of the length, optionally all of the length, of the stepped bore in the block to reduce or prevent dust and fines from entering and wearing the bore surface. When assembled, the stepped sleeve and complementarily shaped shank of the tool pick each do not extend past the rear surface of the bore to mitigate or prevent shank deformation from impact during use.

16 Claims, 6 Drawing Sheets

FULL SLEEVE RETAINER FOR STEP-SHANK OF TOOL

CROSS REFERENCE TO RELATED APPLICATIONS

This application is a §371 National Stage Application of PCT International Application No. PCT/SE2009/050786, filed Jun. 22, 2009, and claims priority under 35 U.S.C. §119 and/or §365 to U.S. Provisional Application No. 61/089,725 filed Aug. 18, 2008.

FIELD

The present disclosure relates to a sleeve for retaining a rotatable tool pick in a block. More particularly, the present disclosure relates to a retainer sleeve that fits about the shank of a rotatable tool pick to form a tool pick assembly and that is inserted into a bore of a block to form an assembly.

BACKGROUND

In the discussion of the background that follows, reference is made to certain structures and/or methods. However, the following references should not be construed as an admission that these structures and/or methods constitute prior art. Applicant expressly reserves the right to demonstrate that such structures and/or methods do not qualify as prior art.

Large trenching machines utilize large plates linked around a boom to form a cutting chain. Blocks to hold the tool picks are welded at the rear of these plates for optimal cutting. FIGS. 1 and 2 show an example of such a plate 10 with a block 12 fixed to a surface 14 with a weld 16. Located in the block 12 is a tool pick 18. Conventional tool picks utilize rear retainers 20 where a portion of the shank of the tool pick 18 extends past the rearward surface 22 of the block 12.

During operation as the chain of long plates travel around the boom to excavate material, the plates 10 pivot. FIG. 3 illustrates a portion of the boom 30 indicating travel direction D of the plates 10. During an excavating portion 32 of the travel cycle, the linked plates 10 are spaced apart due to friction with the material being excavated; during a return portion of the travel cycle, the linked plates 10 are slack and in some locations the plates 10 bend towards one another, reducing the clearance therebetween. In such a circumstance, the edge of the exposed end 24 of the shank of the tool pick 18 can be jammed against the following plate 10, applying a force to the end 24 that can be high enough to deform the exposed shank and/or the rear retainer 20 of the tool pick 18. Also, the contact point 26 on the plate 10 can itself be deformed (see FIG. 2). The deformation can cause the edge of the exposed end 24 to misshapen, for example to spread out into a shape similar to a mushroom, or other portions of the tool pick 18 to misshapen. In such cases, removal of the tool pick 18 through the bore of the block 12 can be complicated and/or prevented. Where used, removal of a rear-retainer or employment of special tools for retainer removal or tool pick removal are likewise complicated and/or prevented by portions of the tool pick being misshapen.

Wear is detrimental to the lifetime performance of assemblies. For example, to encourage pick rotation, there is typically clearance between the pick and its sleeve. However, this clearance allows space for dust and fines to collect between the tool pick and the bore of the block. As rotatable elements of the assembly rotate, this material grinds the opposing elements, thereby enlarging the bore and allowing more fines to enter, accelerating the wear and reducing the life of the block. Similar wear problems can occur between the sleeve and one or more of the bore of the block or the shank of the tool pick if the clearance is too large and dust and fines collect therebetween. With regard to the use of an external retainer, a certain amount of clearance is required between the rear of the block and the groove in the pick shank to assemble the retainer. If too large, this clearance allows unnecessary freedom of movement between the pick and block, causing an unwarranted amount of slapping between the pick shoulder and face of the block. This slapping causes excessive wear in the bore and on the face of the block, reducing its life.

SUMMARY

The above limitations in the prior art are addressed, mitigated and/or eliminated by the presently disclosed step-shank sleeve retainer.

An exemplary tool pick assembly comprises a tool pick including a head portion and a shank portion projecting rearwardly from the head portion, and a sleeve positioned about the shank portion, wherein the sleeve includes a hollow cylindrical body having a first end, a second end and an axially continuous surface therebetween formed by a first surface portion joined to a second surface portion by a stepped portion, a first axially extending slit in the continuous surface extending from the first end to the second end, and a tool pick retaining feature, wherein the first surface portion of the sleeve has a larger diameter than the second surface portion of the sleeve and the stepped portion of the sleeve has an axially varying diameter, wherein the tool pick retaining feature projects radially inward from the second surface portion into a circumferential channel in the shank portion, wherein the shank portion has a first surface portion and a second surface portion, a diameter of the first surface portion being larger than a diameter of the second surface portion, and a stepped portion with an axially varying diameter, and wherein the first surface portion of the sleeve extends an entire axially distance of the first surface portion of the shank portion and the second surface portion of the sleeve extends at least a portion of the axial distance of the second surface portion of the shank portion.

An exemplary tool and block assembly comprises a block including a body having a bore extending axially from a first side to a second side, a tool pick including a head portion and a shank portion projecting rearwardly from the head portion, and a sleeve positioned about the shank portion, wherein the sleeve includes a hollow cylindrical body having a first end, a second end and an axially continuous surface therebetween formed by a first surface portion joined to a second surface portion by a stepped portion, a first axially extending slit in the continuous surface extending from the first end to the second end, and a tool pick retaining feature, wherein the first surface portion of the sleeve has a larger diameter than the second surface portion of the sleeve and the stepped portion of the sleeve has an axially varying diameter, wherein the tool pick retaining feature projects radially inward from the second surface portion into a circumferential channel in the shank portion of the tool pick, wherein the shank portion has a first surface portion and a second surface portion, a diameter of the first surface portion being larger than a diameter of the second surface portion, and a stepped portion with an axially varying diameter, wherein the first surface portion of the sleeve extends an entire axially distance of the first surface portion of the shank portion and the second surface portion of the sleeve extends at least a portion of the axial distance of the second surface portion of the shank portion, wherein an inner diameter surface of the bore is complimentarily shaped to the axially continuous surface of the sleeve and forms a friction fit therewith, and wherein the tool pick is rotatable.

An exemplary excavating machine comprises a rotatable member and a tool and block assembly mounted thereon.

It is to be understood that both the foregoing general description and the following detailed description are exemplary and explanatory and are intended to provide further explanation of the invention as claimed.

BRIEF DESCRIPTION OF THE DRAWING

The following detailed description can be read in connection with the accompanying drawings in which like numerals designate like elements and in which.

DETAILED DESCRIPTION

Figure 1:
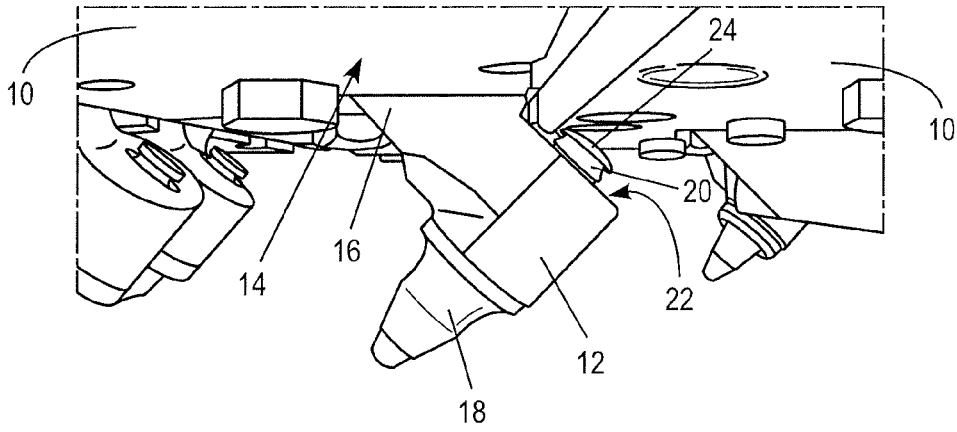
(PRIOR ART) FIG. 1
FIG. 1 shows a prior art block attached to a plate of a cutting chain on a trenching machine.
Figure 2:
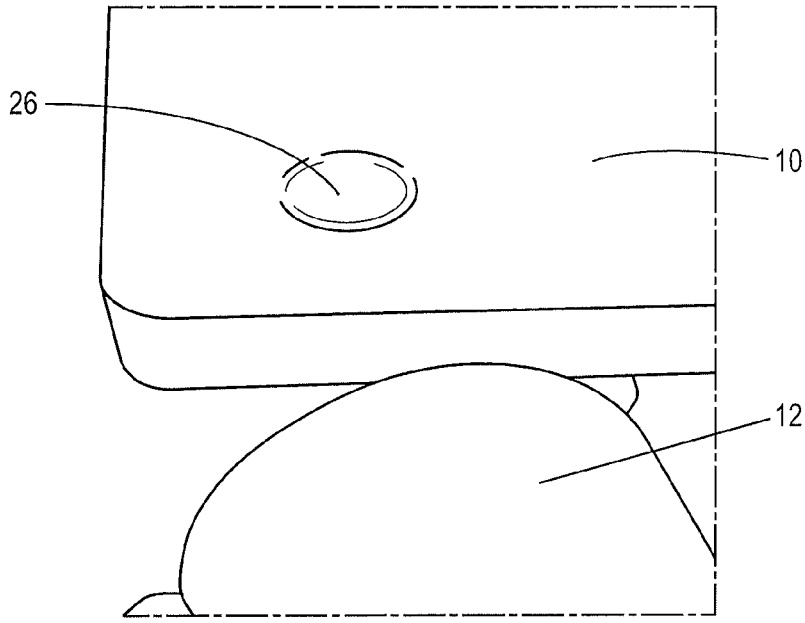
(PRIOR ART) FIG. 2
FIG. 2 shows another view of the block and plate in FIG. 1.
Figure 3:
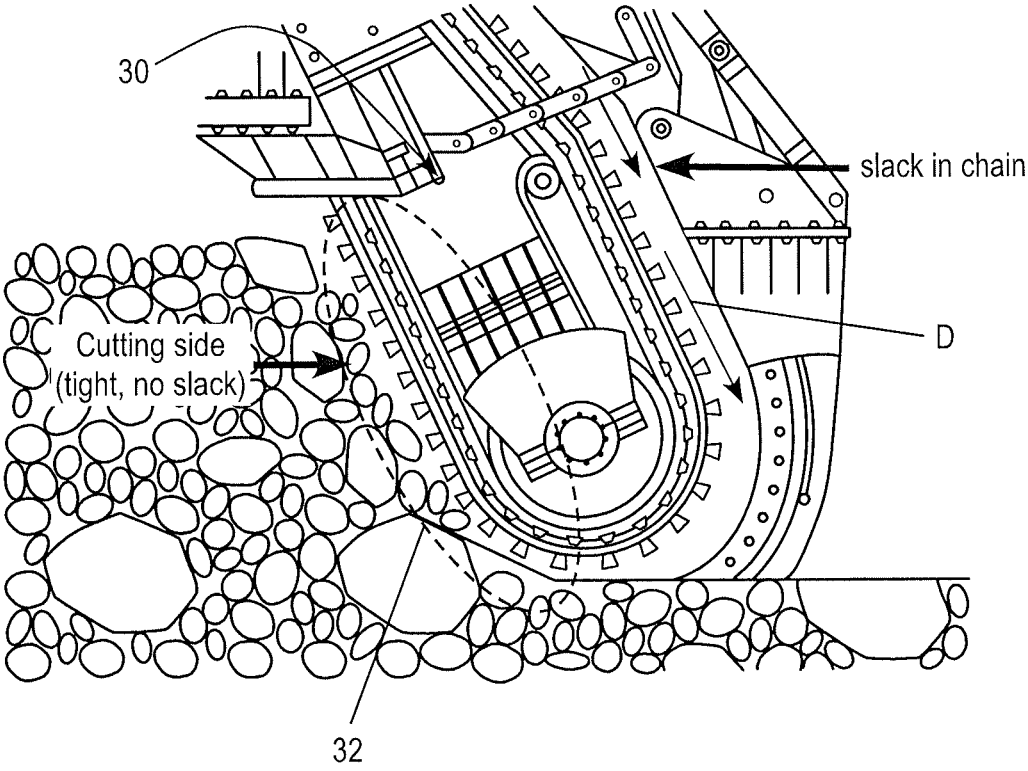
(PRIOR ART) FIG. 3
FIG. 3 shows a schematic of the operation of a boom to excavate material.
Figure 4:
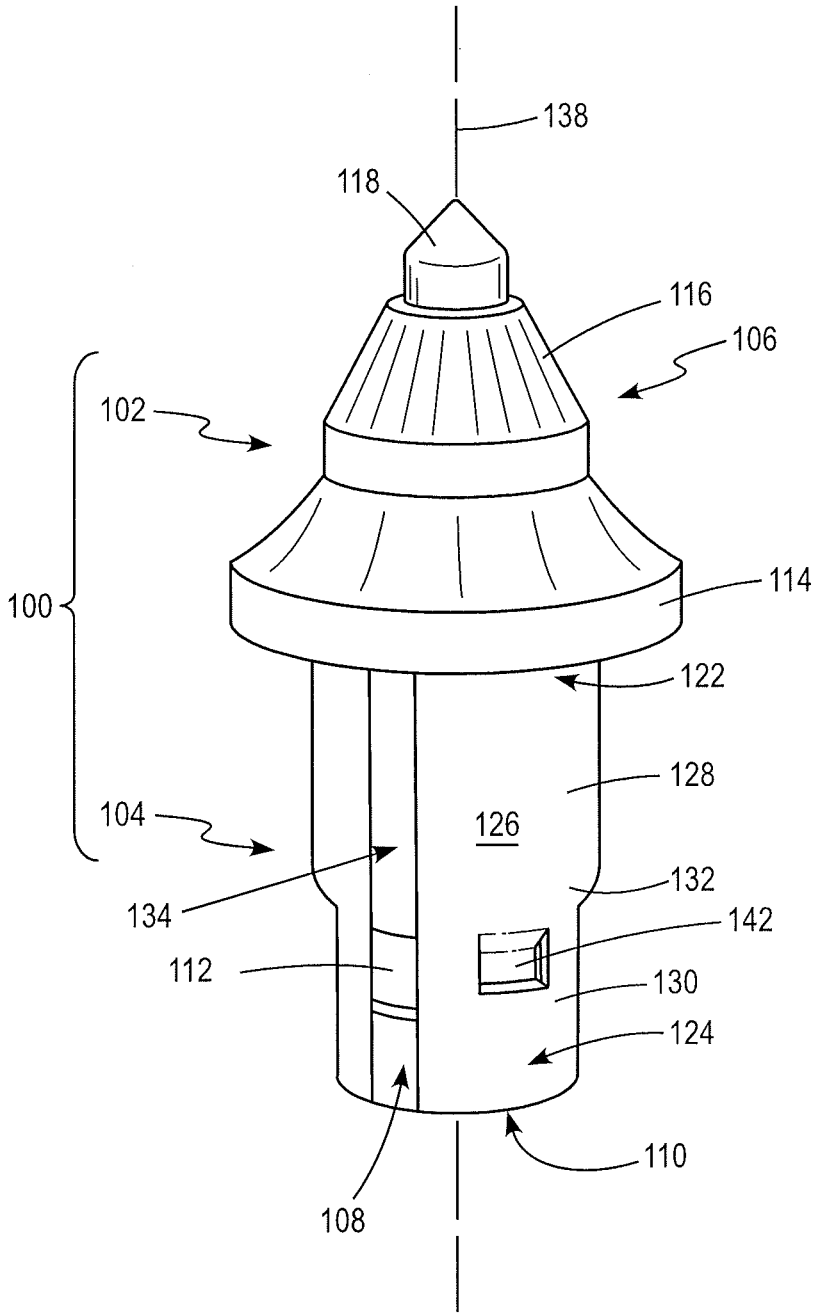
FIG. 4 shows an exemplary embodiment of a tool pick assembly.

FIG. 4 shows an exemplary embodiment of a tool pick assembly 100. In the illustrated embodiment, the tool pick assembly 100 comprises a tool pick 102 and a sleeve 104.

The tool pick 102 includes a head portion 106 and a shank portion 108. The shank portion 108 projects rearwardly from the head portion 106 with an end 110 of the shank portion distal from the head portion 106. The shank portion 108 includes a circumferential channel 112 or other depression that can be used for tool pick retention. The head portion 106 of the tool pick 102 can include any suitable features, including, for example, a shoulder region 114, a tapered region 116 and a tip 118. The tip 118 can be made from a hard material, such as tungsten carbide.

The sleeve 104 includes a hollow cylindrical-like body having a first end 122, a second end 124, and an axially continuous surface 126 therebetween. The axially continuous surface 126 is formed by a first surface portion 128 joined to a second surface portion 130 by a stepped portion 132. The continuous surface 126 includes a first axially extending slit 134 extending from the first end 122 to the second end 124. The axially extending slit 134 allows for circumferential compression of the sleeve 104 when installed in a bore of a block.

Figure 5:
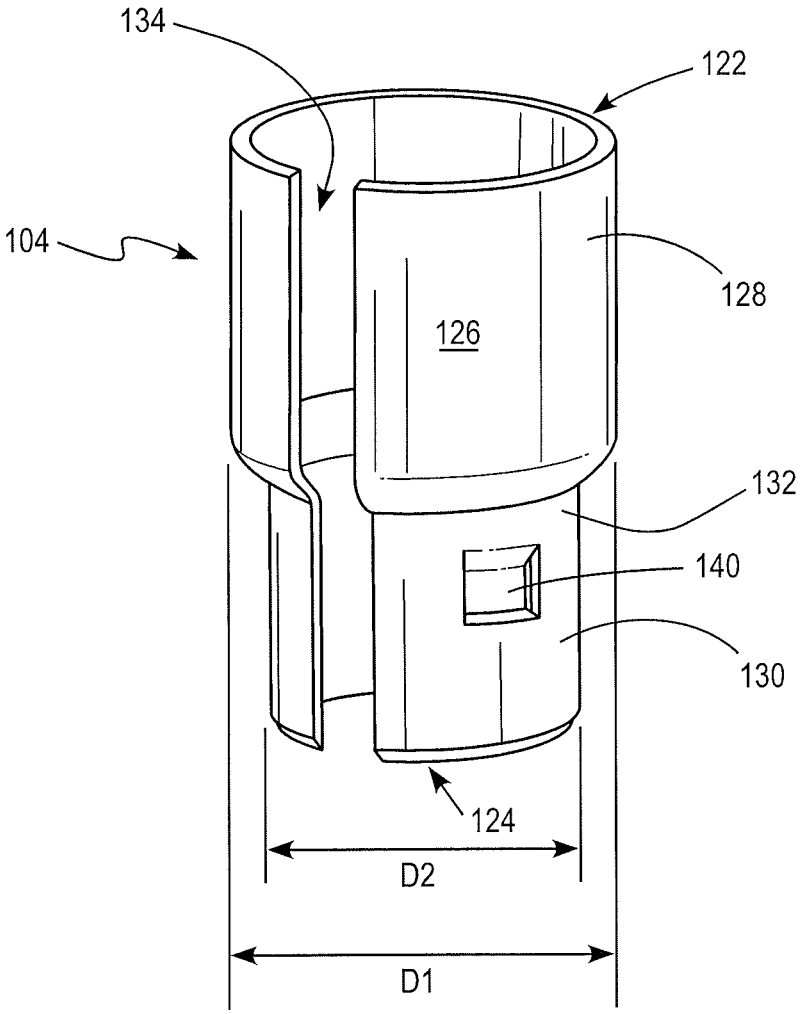
FIG. 5 shows an exemplary embodiment of a sleeve.

The first surface portion 128 of the sleeve 104 has a larger diameter D1 than the diameter D2 of the second surface portion 130 of the sleeve 104. Connecting the first surface portion 128 and the second surface portion 130 is a stepped portion 132. The stepped portion 132 has an axially varying diameter. In exemplary embodiments, the second surface portion 128 of the sleeve 104 is a rearwardmost portion (e.g., rearwardmost relative to the head portion of the tool pick when the sleeve is positioned about the shank). FIG. 5 shows an exemplary embodiment of a sleeve 104 and illustrates the relationships between the first surface portion 128, the second surface portion 130, the respective diameters D1 and D2, and the stepped portion 132.

There may be various relationships between the surfaces and diameters in exemplary embodiments of sleeves. For example, the diameter D1 of the first surface portion 128 of the sleeve 104 can be constant along the axial extent of the first surface portion 128 and the diameter D2 of the second surface portion 130 of the sleeve 104 can also be constant along the axial extent of the second surface portion 130. Also, for example, the diameter D1 of the first surface portion 128 can be the largest diameter of the sleeve 104.

The sleeve 104 is positioned about the shank portion 108 to allow rotation of the tool pick 102 about its axis 138. Thus, the sleeve 104 is not in friction fit contact with the shank portion 108 of the tool pick 102. However, the sleeve 104 is retained about the shank portion 108 to limit axial movement and includes a tool pick retaining feature. The tool pick retaining feature projects radially inward from the second surface portion 130 into a circumferential channel 112 in the shank portion 108. An example of a tool pick retaining feature is shown in the figures as one or a plurality of tabs 140. Other examples include one or a plurality of bumps or ridges or other projections.

Figure 6:
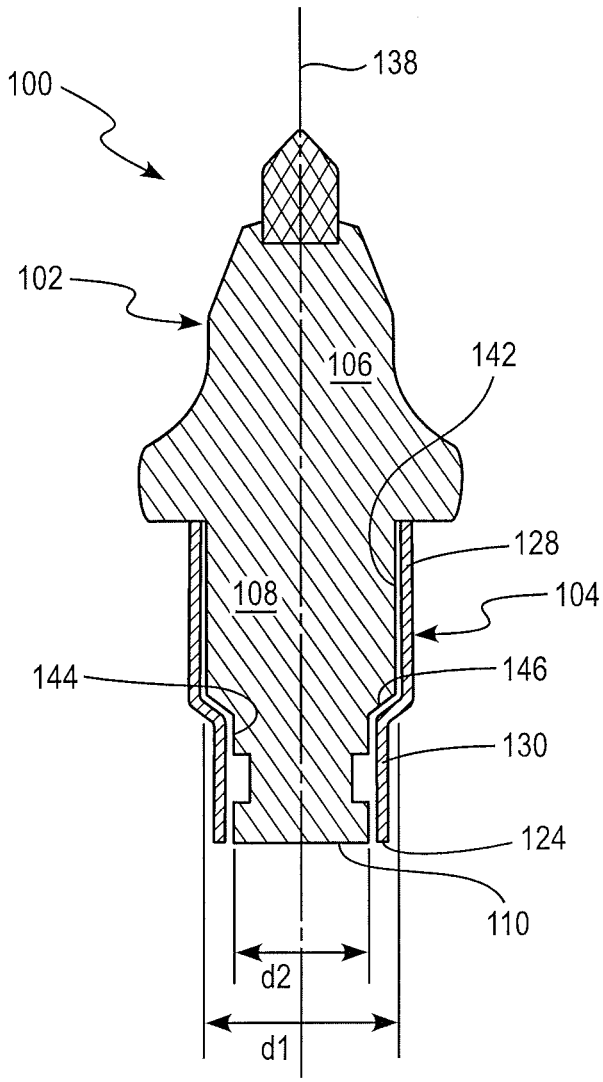
FIG. 6 is a schematic representation of a cut-away view of the tool pick assembly of FIG. 4

FIG. 6 is a schematic representation of a cut-away view of the tool pick assembly of FIG. 4. FIG. 6 illustrates an example of interaction between the sleeve 104 and tool pick 102 in the tool pick assembly 100. In an exemplary embodiment, the shape of the shank portion 108 is approximately the same as the inner diameter surface of the sleeve 104, allowing for relative rotation and the tool pick retaining feature. For example, the shank portion 108 has a first surface portion 142 and a second surface portion 144, where a diameter d1 of the first surface portion 142 is larger than a diameter d2 of the second surface portion 144 and a stepped portion 146 with an axially varying diameter connects the first surface portion 142 and the second surface portion 144. To allow relative rotation, diameter d1 is less than diameter D1 and/or diameter d2 is less than diameter d2. Also, for example, the first surface portion 128 of the sleeve 104 extends an entire axially distance of the first surface portion 142 of the shank portion 108 and the second surface portion 130 of the sleeve 104 extends at least a portion of the axial distance of the second surface portion 144 of the shank portion 108. In alternative embodiments, the sleeve 104 extends the entire length of the axial distance of the second surface portion 144 of the shank portion 108, e.g., the end 110 of the shank portion 108 distal from the head portion 106 is axially coterminous with the second end 124 of the sleeve 104.

Figure 7:
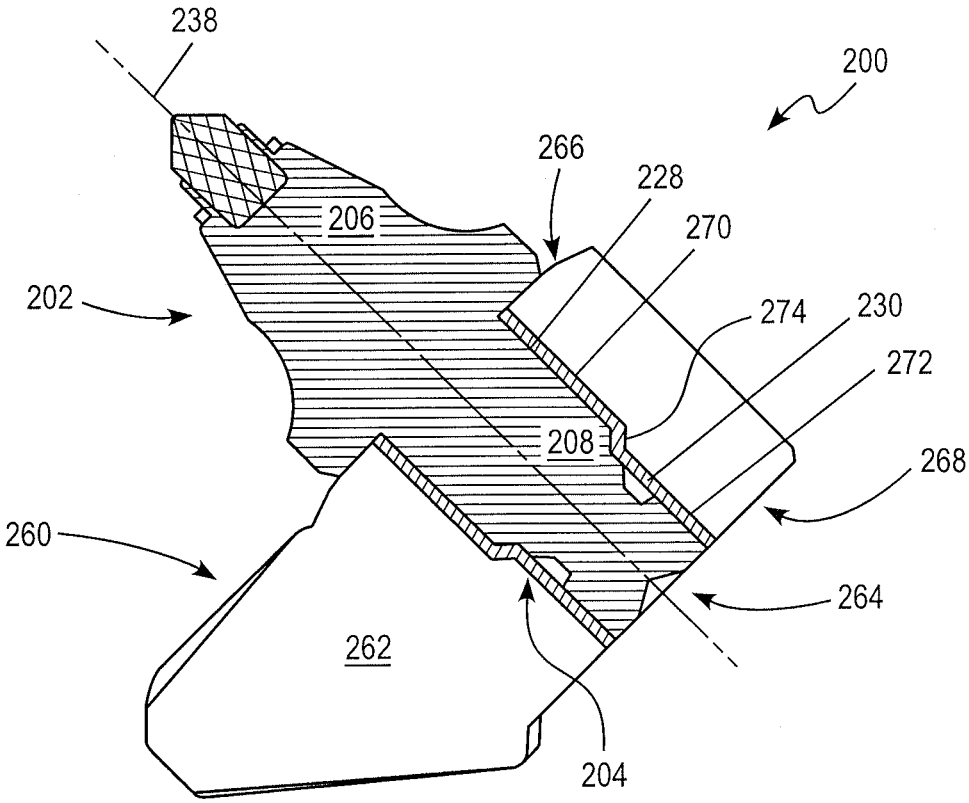
FIG. 7 shows an exemplary embodiment of a tool and block assembly in cross-section.

FIG. 7 shows an exemplary embodiment of a tool and block assembly 200 in cross-section. The exemplary embodiment of a tool and block assembly 200 comprises a block 260 including a body 262 having a bore 264 extending axially from a first side 266 to a second side 268. A tool pick assembly is positioned in the bore 264 of the block 260. The tool pick assembly comprises a tool pick 202 and a sleeve 204. The tool pick 202 includes a head portion 206 and a shank portion 208 projecting rearwardly from the head portion 206. The sleeve 204 is positioned about the shank portion 208. The tool pick 202 and sleeve 204 in the tool and block assembly 200 are substantially the same and have substantially the same features as those disclosed and described herein in connection with the tool pick and sleeve of FIGS. 4-6.

As shown in FIG. 7, the tool pick assembly is positioned in the bore 264 of the block 260. The tool pick 202 is rotatable relative to the sleeve 204 about axis 238. An inner diameter surface of the bore 264 is complimentarily shaped to the axially continuous surface of the sleeve 204 and at least portions of the axially continuous surface form a friction fit with the inner diameter surface of the bore 264. For example, the bore 264 has two portions 270, 272 with different diameters with a stepped portion 274 therebetween with an axially varying diameter. In the free- or static-state, the diameters of at least one of the first surface portion 228 and the second surface portion 230 of the sleeve 204, optionally the diameters of both of the first surface portion 228 and the second surface portion 230 of the sleeve 204, are larger than the diameters of the corresponding portions 270, 272 of the bore 264. Because the sleeve 204 is circumferentially compressible, the sleeve 204 compresses to fit inside the bore 264 and the elastic properties of the sleeve 204 provide for friction retention of the sleeve 204 in the bore 264. In this compressed, friction-retention state, the relationship of the sizes of the diameters of the sleeve surface portions 228, 230 relative to the shank portion 208 remains such that the tool pick 202 is rotatable relative to the sleeve 204, which is itself substantially stationary, if not stationary, relative to the block 260 by operation of the friction fit.

Installation of the tool and pick assembly into the block can be by any suitable means. In an exemplary embodiment, an operator can use a standard dead-blow hammer to knock the tool and pick assembly into the block. When installed, the sleeve is positioned tightly against the bore and seals out dust and fines from grinding into the bore wall. Fines that do approach the holder enter between the shank of the tool pick and the sleeve. However, this is generally acceptable since the tool pick and the sleeve are replaced with new parts during every pick change.

It is noted that the retention method disclosed herein can be used with various blocks. For example, internally grooved bores are not needed for the disclosed sleeve, although internally grooved bores will not diminish the performance of the tool pick nor diminish the retention from that of a smooth bore.

The disclosed tool and block assembly 200 can be incorporated into an excavating machine, such as Tesmec model TRS-900 and Trencor model 1660HDE. In an exemplary embodiment, the excavating machine comprises a rotatable member with the tool and block assembly mounted thereon. An example rotatable member is the chain of long plates travelling around a boom to excavate material.

Although described in connection with preferred embodiments thereof, it will be appreciated by those skilled in the art that additions, deletions, modifications, and substitutions not specifically described may be made without department from the spirit and scope of the invention as defined in the appended claims.

The disclosures in the U.S. provisional patent application No. 61/089,725 from which this application claims priority, are incorporated herein by reference.

The invention claimed is:

1. A tool pick assembly, comprising:

a tool pick including a head portion and a shank portion projecting rearwardly from the head portion; and a sleeve positioned about the shank portion, wherein the sleeve includes a hollow cylindrical body having a first end, a second end and an axially continuous surface therebetween formed by a first surface portion joined to a second surface portion by a stepped portion, a first axially extending slit in the continuous surface extending from the first end to the second end, and a tool pick retaining feature, wherein the first surface portion of the sleeve has a larger diameter than the second surface portion of the sleeve and the stepped portion of the sleeve has an axially varying diameter, wherein the tool pick retaining feature projects radially inward from the second surface portion into a circumferential channel in the shank portion, wherein the shank portion has a first surface portion and a second surface portion, a diameter of the first surface portion being larger than a diameter of the second surface portion, and a stepped portion with an axially varying diameter, and wherein the first surface portion of the sleeve extends an entire axially distance of the first surface portion of the shank portion and the second surface portion of the sleeve extends at least a portion of the axial distance of the second surface portion of the shank portion.

2. The tool pick assembly of claim 1, wherein the second surface portion of the sleeve extends an entire axial distance of the second surface portion of the shank portion.

3. The tool pick assembly according to claim 1, wherein the diameter of the first surface portion of the sleeve is constant and the diameter of the second surface portion of the sleeve is constant.

4. The tool pick assembly according to claim 1, wherein the second surface portion of the sleeve is a reanmardmost portion of the sleeve.

5. The tool pick assembly according to claim 1, wherein the diameter of the first surface portion is the largest diameter on the sleeve.

6. The tool pick assembly according to claim 1, wherein the hollow cylindrical body is circumferentially compressible.

7. The tool pick assembly according to claim 1, wherein an end of the shank portion distal from the head portion is axially coterminous with the second end of the sleeve.

8. A tool and block assembly, comprising:

a block including a body having a bore extending axially from a first side to a second side;

a tool pick including a head portion and a shank portion projecting rearwardly from the head portion; and a sleeve positioned about the shank portion, wherein the sleeve includes a hollow cylindrical body having a first end, a second end and an axially continuous surface therebetween formed by a first surface portion joined to a second surface portion by a stepped portion, a first axially extending slit in the continuous surface extending from the first end to the second end, and a tool pick retaining feature, wherein the first surface portion of the sleeve has a larger diameter than the second surface portion of the sleeve and the stepped portion of the sleeve has an axially varying diameter, wherein the tool pick retaining feature projects radially inward from the second surface portion into a circumferential channel in the shank portion of the tool pick, wherein the shank portion has a first surface portion and a second surface portion, a diameter of the first surface portion being larger than a diameter of the second surface portion, and a stepped portion with an axially varying diameter, wherein the first surface portion of the sleeve extends an entire axially distance of the first surface portion of the shank portion and the second surface portion of the sleeve extends at least a portion of the axial distance of the second surface portion of the shank portion, wherein an inner diameter surface of the bore is complimentarily shaped to the axially continuous surface of the sleeve and forms a friction fit therewith, and wherein the tool pick is rotatable.

9. The tool and block assembly of claim 8, wherein the second surface portion of the sleeve extends an entire axial distance of the second surface portion of the shank portion.

10. The tool and block assembly according to claim 8, wherein the diameter of the first surface portion of the sleeve is constant and the diameter of the second surface portion of the sleeve is constant.

11. The tool and block assembly according to claim 8, wherein the diameter of the first surface portion of the sleeve is greater than the diameter of the second surface portion of the sleeve.

12. The tool and block assembly according to claim 8, wherein the second surface portion of the sleeve is a rearwardmost portion of the sleeve.

13. The tool and block assembly according to claim 8, wherein the diameter of the first surface portion is the largest diameter on the sleeve.

14. The tool and block assembly according to claim 8, wherein the hollow cylindrical body is circumferentially compressible.

15. The tool and block assembly according to claim 8, wherein an end of the shank portion of the tool pick distal from the head portion is axially coterminous with the second end of the sleeve.

16. An excavating machine, comprising: a rotatable member; and the tool and block assembly according to claim 8 mounted on the rotatable member.

* * * * *